United States Patent [19]

Craven et al.

[11] 3,938,781

[45] Feb. 17, 1976

[54] LEVEL WIND FOR WINCH

[75] Inventors: Truxtun Craven; Carlyle A. Crecelius; Clayton W. Philbrick, all of Vashon, Wash.

[73] Assignee: Olympic Instruments Inc., Vashon, Wash.

[22] Filed: Oct. 12, 1972

[21] Appl. No.: 296,787

[52] U.S. Cl. ..... 254/175.7; 254/190 R

[51] Int. Cl. ..... B66d 1/76

[58] Field of Search ..... 254/175.7, 190; 242/157.1; 187/27

[56] References Cited

UNITED STATES PATENTS 3,690,409 9/1972 Brauss ..... 187/27

*Primary Examiner*—Allen N. Knowles

*Attorney, Agent, or Firm*—Seed, Berry, Vernon & Baynham

[57] ABSTRACT

A winch and its power source are anchored as a unit by means of a pair of rearwardly extending flexible cables secured to a suitable fixed object. Extending forwardly from the winch frame is a cable guide controlling the lateral movement of cable to be wound about the drum of the winch. As a cable is wound, the winch unit pivots about a vertical axis, which it automatically establishes, until the cable reaches one end of the drum. Just before the layer is completed, the cable contacts a vertical bar mounted on the cable guide, adjacent the end of the drum, the guide exerting an inwardly directed lateral force causing the winch to pivot about the established vertical axis in the opposite direction and causes the cable to move up one layer and wind a succeeding overlapping layer in the opposite direction until the opposite end of the drum is reached, at which time the action is repeated.

8 Claims, 2 Drawing Figures

LEVEL WIND FOR WINCH

BACKGROUND OF THE INVENTION

The use of large winches mounted upon vehicles or relatively fixed, large winches driven by their own power source is well-known in the art. These known winches are necessary and useful items but there must of necessity be access by which the bulky equipment can reach the desired location or alternatively there must be a large enough demand for the winch to justify the building of a road or other access means whereby the winch may be transported to the location of intended use.

There has developed a need for a small portable winch which can be carried to inaccessible areas by hand and be attached on site to a portable power source. The demand for timber has increased to the point where it is being harvested from terrain previously ignored because of the expense and/or inconvenience. The suburbanite, the hunter and the gentleman farmer find need for a large pulling power and would like to have assistance in this operation without investing a great deal of capital. In addition, a need has been developed for a small portable winch with high capacity pulling power relative to its weight and size which may be used in conjunction with a mobile power source such as a chain saw engine.

Many people have a chain saw at their disposal. It is, of course, extremely desirable to be able to use the engine of the chain saw in conjunction with a portable winch without structural change to the saw itself. It is also desirable to be able to rapidly convert a chain saw to use the same engine with a portable winch. Rapid conversion without structural change in the chain saw allows use of the saw in both modes without severely hindering the use for which it was designed.

Small winches which are adapted to be powered by engines such as chain saw engines are known as shown by U.S. Pat. No. 2,869,822 issued Jan. 20, 1959, and U.S. Pat. No. 3,197,162 issued July 27, 1965. Although these patents teach driving a small winch by means of a chain saw or other portable power source, they do not disclose any means for level winding the cable on the drum. This is extremely critical during outfeed of the cable for smooth and uniform feed and is important in wrapping the maximum amount of cable about a drum. Level winding avoids serious damage or destruction of the cable which frequently occurs when randomly or loosely wound cable about a winch drum is subjected to severe tension loading.

It is an object of the present invention to provide a small winch adapted to be powered by a light weight prime mover wherein the winch includes, as an integral part thereof, means assuring that the cable will be wound upon the drum in a plurality of smooth layers.

It is another object of the present invention to provide an attachment to a small portable winch so that the winch, although secured to a dead man, may pivot about a vertical axis causing the cable to sequentially and smoothly wrap across the drum, first in one direction and then in the other.

Still another object of the invention is to provide a small portable winch which pivots about a vertical axis and which has a forwardly extending cable guide to restrict the relative angle of approach of the cable to the winch and provide means for causing the cable to smoothly move up to the next layer when reaching the end of the drum on any given particular layer, thus assuring a smooth and level wind.

DETAILED DESCRIPTION OF THE DRAWINGS

Figure 1:
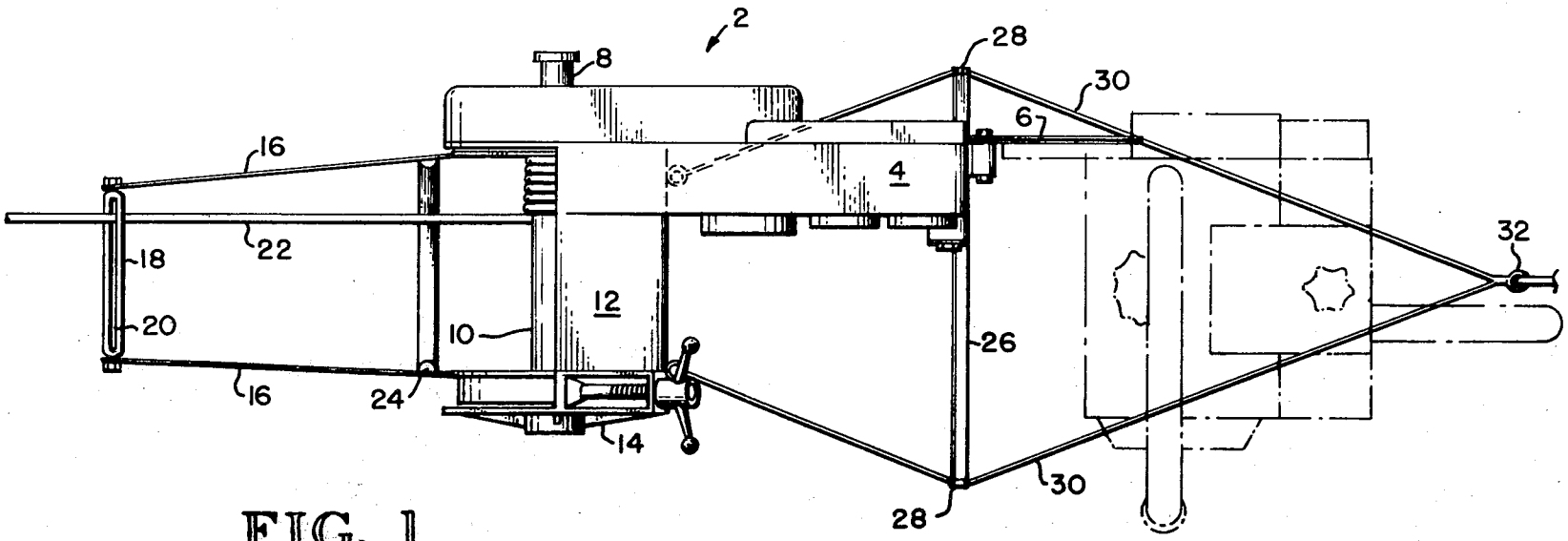
FIG. 1 is a plan view of a small portable winch adapted to be powered by a chain saw engine having attached thereto the level wind mechanism of this invention.
Figure 2:
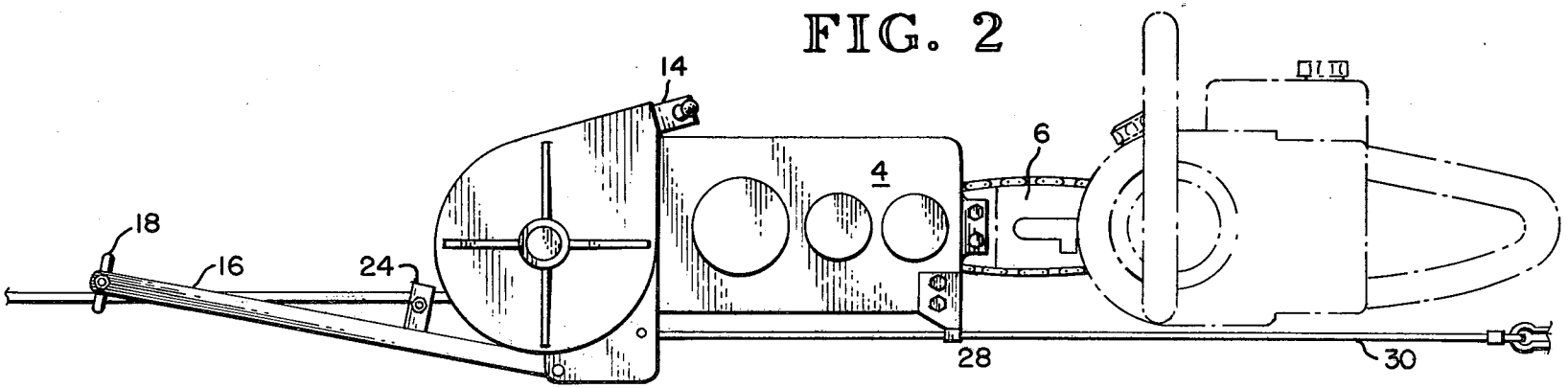
FIG. 2 is an elevational view of the winch and level wind mechanism as seen in FIG. 1.

In FIG. 1, the portable winch including the novel level wind mechanism is adapted to be attached to a chain saw engine, as shown in phantom. The main winch housing 2 includes a structural portion and cover for the drive train 4 which receives its motive power from the saw engine which is fitted with a bar 6. The saw engine transmits its rotational power via a chain which is guided by adapter bar 6, driving a series of gears within the housing 4 through a manually engageable clutch having a control handle 8. The drum itself, 10, is partially shielded by housing 12 and includes at the opposite end of the clutch mechanism a brake 14.

Extending forwardly from the drum is a cable guide which includes a pair of forwardly extending arms 16 joined at their outer end by a guide throat 18 which includes horizontal slot 20 through which a cable 22 may pass. The rear end of the bar 16 is pivotally attached to the housing so that the guide may move upwardly and downwardly as the wrap diameter on the drum changes. Intermediate the ends of the guide are a pair of upwardly extending smoothly curved guides 24 which are located to be contacted by the cable 22 when it reaches the end of one wrap and, as to be explained in greater detail hereinafter, provides an inwardly directed force causing the cable to reverse directions on the next subsequent wrap.

Mounted to the rear of the housing 2 of the winch is a spreader bar 26 which is mounted to the housing 2 such that it extends outwardly on both sides of the center of the drum equidistantly. The outer ends of the spreader 26 include cable retainers 28. A pair of equal length cables 30 are secured to the under portion of the housing 2, extend rearwardly through the retainers 28 and terminate in a hook 32 or other fastening means suitable for attachment to a fixed object, commonly known as a "dead man."

It is to be noted at this point that the cable retainers, the spreader and the anchor points for the cable 30 and the housing 2 are all equally spaced along lines perpendicular to a center line which passes through the longitudinal center of the drum thus completely balancing the winch portion of the mechanism.

In operation, the saw engine, or any other suitable power source, is secured to the winch housing so that the power is transmitted via the gear train to the drum which may be selectively driven by engagement of the clutch 8. As the cable is rolled onto the drum, it proceeds across the drum laying one wrap of cable adjacent the previous wrap. As the cable approaches the outer limits of one side of the drum, it exerts a biasing force on the winch unit and engine which are secured together as a unit causing the winch to pivot about a vertical axis approximately through the drum.

As the winch pivots, it puts a greater strain on the cable 30 opposing the direction of pivot and simultaneously causes the cable, on rolling, to contact one of the cable guides 24. There is sufficient force exerted between a combination of the lateral force exerted by cable guide 24 and the force generated by uneven loading on the two portions of cable 30 that the cable elevates one wrap and begins another layer in the opposite direction. This process repeats itself at the opposite end of the drum until the drum is either full or until the cable is fully wound, so that the cable is continuously and smoothly wrapped in succeeding layers on the drum 10. The present invention provides for a small portable winch and an inexpensive and trouble-free means of assuring a level wind.

The embodiments of the invention in which an exclusive property or privilege is claimed are defined as follows:

1. A level wind winch for use in combination with a power source, comprising:

a winch unit including a frame and a winch drum mounted for rotation about its central axis to the frame, flexible rope means secured about the drum, a flexible bridle comprising a pair of equal length cables securing opposite sides of the winch frame to a common fixed point of attachment rearwardly of the winch frame, a spreader bar of greater length than the winch drum extending intermediate the point of attachment and the winch frame substantially parallel to the central axis of rotation of the winch drum, cable retainers on the outer ends of the spreader bar through which the cables of the flexible bridle pass, the bridle allowing the winch unit to pivot about an imaginary vertical line perpendicular to the central axis of the winch drum and intermediate the winch drum and spreader bar when the rope means is being wrapped about the winch drum under tension and approaches either of the ends of the drum, the force generated by uneven loading on the flexible bridle elevating the rope means one wrap and causing the rope means to reverse directions and begin wrapping a succeeding layer over the initial layer.

2. The winch of claim 1 including deflectors positioned adjacent the ends of the drum for deflecting the rope laterally inwardly when the end of the drum is reached, the deflector aiding in elevating the rope means by exerting, on contact with the rope means, an inwardly directed force acting in combination with the force generated by uneven loading on the bridle.

3. The winch of claim 1 including a pair of rigid arms secured to and extending forwardly of the winch frame.

4. The winch of claim 3 wherein the deflectors are a pair of vertical posts, one secured to each of the rigid arms adjacent each of the ends of the winch drum.

5. The winch of claim 3 wherein the rigid arms are pivotally connected to the winch frame, permitting the arms to move vertically as the wrap diameter of the rope means on the drum changes.

6. The winch of claim 5 wherein the rigid arms are joined at their outer ends by a slotted bar through which the rope means passes.

7. The winch of claim 1 wherein the retainers, spreader bar and points of attachment of the cables of the flexible bridle are along imaginary lines perpendicular to the central axis of the winch drum.

8. A portable winch that level winds under load, comprising:

a winch unit including a winch frame and a winch drum mounted for rotation about its central axis to the frame, a gear train mounted on said winch frame, manually engageable clutch means for engaging and disengaging the winch drum to said gear train, a portable power source operatively connected to said gear train, flexible rope means secured about the winch drum, a pair of rigid arms secured to the winch frame and extending from the winch drum, the rigid arms joined at their outer ends by a slotted bar through which the flexible rope means passes, a pair of vertical deflector posts, one secured to each of the rigid arms adjacent each end of the winch drum for deflecting the rope means laterally inwardly when the end of the drum is reached, a flexible bridle comprising a pair of equal length cables securing opposite sides of the winch frame to a common fixed point of attachment rearwardly of the winch drum, cable retainers on the outer ends of the spreader bar through which the cables of the flexible bridle pass, the bridle allowing the winch unit to pivot about an imaginary vertical line perpendicular to the central axis of the winch drum and intermediate the winch drum and spreader bar when the rope means is being wrapped about the winch drum under tension and approaches either of the ends of the drum, the rope means at the end of the drum contacting the deflector adjacent the end of the drum, the deflector exerting sufficient inwardly directed lateral force in combination with the force generated by uneven loading on the flexible bridle to elevate the rope means one wrap and cause the rope means to reverse directions and begin wrapping a succeeding layer over the initial layer.

* * * * *